United States Patent [19]

Brooks et al.

[11] 4,212,509

[45] Jul. 15, 1980

[54] ELECTRICAL CONNECTOR ASSEMBLY

[75] Inventors: Hubert C. Brooks; Alan E. Stroh, both of Fort Wayne, Ind.

[73] Assignee: Essex Group, Inc., Fort Wayne, Ind.

[21] Appl. No.: 968,159

[22] Filed: Dec. 11, 1978

[51] Int. Cl.[2] ..... H01R 9/08

[52] U.S. Cl. ..... 339/95 D; 339/97 R

[58] Field of Search ..... 339/95 D, 97 R, 97 P, 339/98, 99 R

[56] References Cited

U.S. PATENT DOCUMENTS

| | | | |
|---|---|---|---|
| 3,892,460 | 7/1975 | Izraeli | 339/98 |
| 3,979,615 | 9/1976 | Neff | 339/97 R |
| 4,038,573 | 7/1977 | Hillyer | 339/97 R |
| 4,130,331 | 12/1978 | Neff et al. | 339/97 R |

FOREIGN PATENT DOCUMENTS

| | | | |
|---|---|---|---|
| 2743242 | 3/1978 | Fed. Rep. of Germany | 339/97 R |

*Primary Examiner*—Joseph H. McGlynn

*Attorney, Agent, or Firm*—Lawrence E. Freiburger; Robert D. Sommer

[57] ABSTRACT

A connector assembly in which a W-shaped clip inserted in a housing cavity makes electrical contact to an insulated electrical conductor in the housing. Each leg of the W-shaped clip has a wire receiving slot therein, which extends from the bight of the leg partially up the walls of the leg. Further, the slots in each leg are parallel to one another and are axially aligned with one another, so that as the clip is inserted into the cavity, the wire receiving slots cut through the film type insulation on the conductor to make electrical contact to it. A pair of wire guiding slots in the housing and a wire support platform serve to locate the wire in the cavity for proper positioning to insert the clip. In addition, one of the wire guiding slots is shorter than the other, and cooperates with a wire receiving slot to permit the end of the electrical conductor to be pulled slightly into the cavity when the clip is inserted therein.

3 Claims, 6 Drawing Figures

FIG. 1
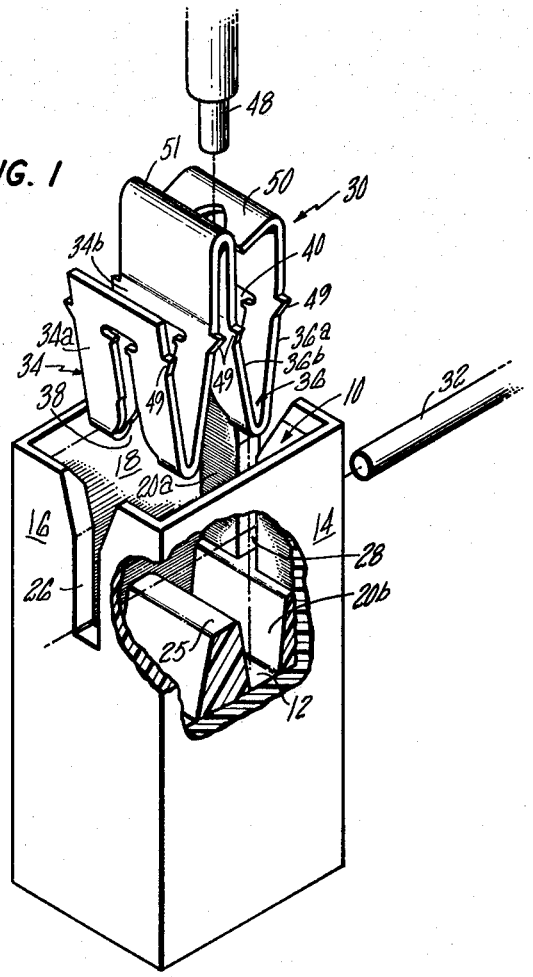
FIG. 3
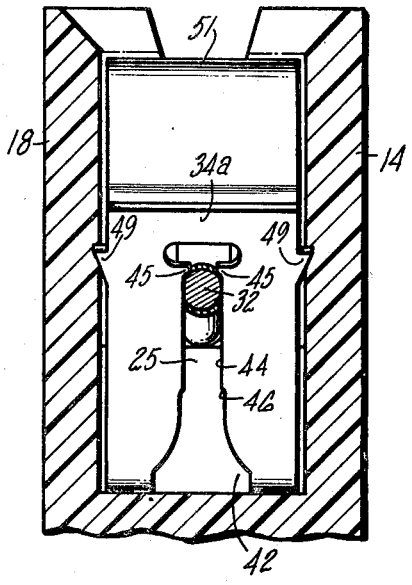
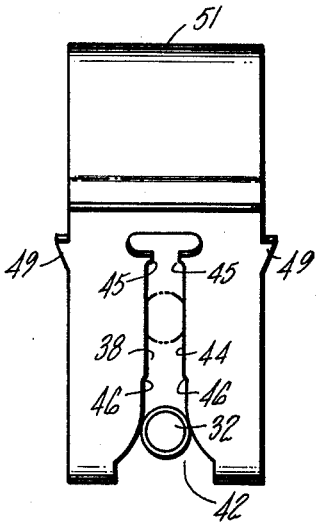
FIG. 2
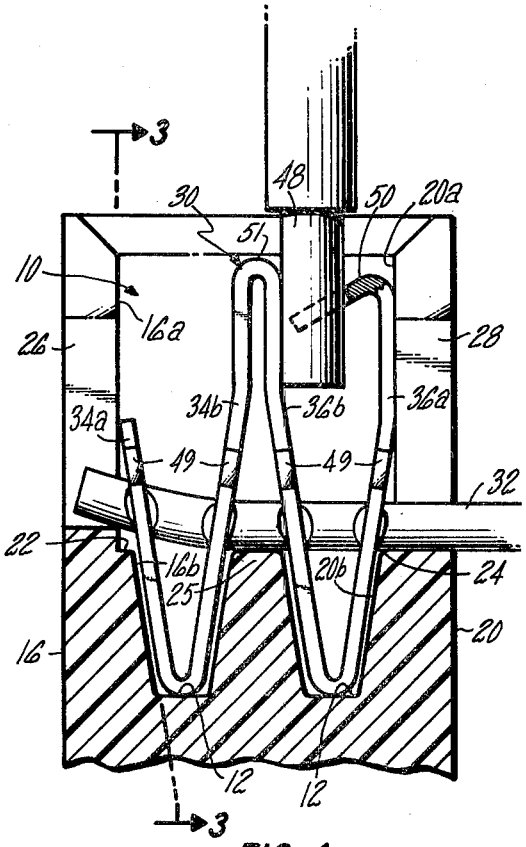
FIG. 4

FIG.5
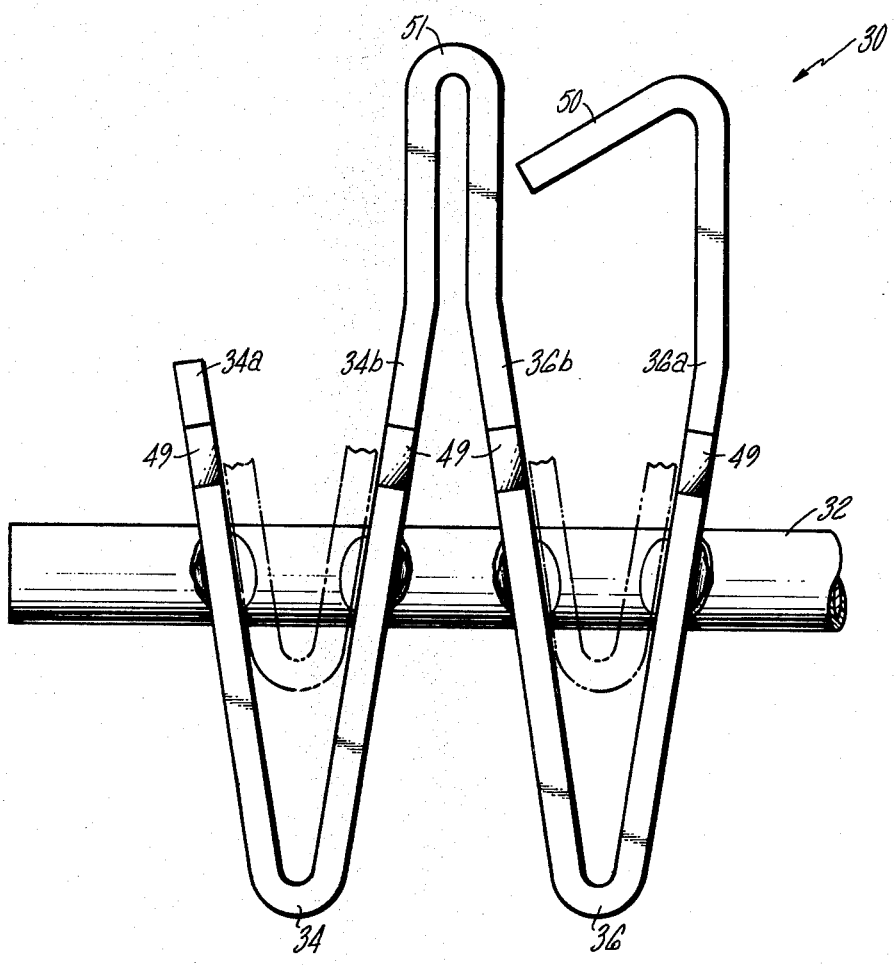
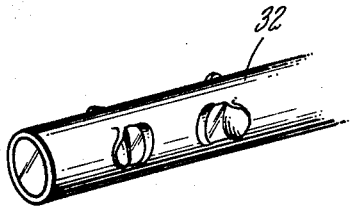
FIG.6

ELECTRICAL CONNECTOR ASSEMBLY

BACKGROUND OF THE INVENTION

In the prior art, it is well known to make electrical connections to the coils of an electromagnetic device by utilizing a solderless terminating assembly which includes: a plastic housing on the device which has a plurality of cavities therein, each of which receives a coil lead; and an electrical terminal inserted into each cavity which serves to cut through the insulation on the coil lead and make electrical contact to the electrical conductor. Typical prior art coil terminating assemblies are disclosed in U.S. Pat. No. 3,979,615 issued Sept. 6, 1976 to Nelson Edward Neff and U.S. Pat. No. 4,038,573 issued July 26, 1977 to Michael J. Hillyer et al.

In both of the above-noted prior art coil termination assemblies, the coil lead insulated with a film type insulation is suitably positioned in the cavity and the electrical terminal inserted into the cavity makes four points of electrical contact with the electrical coil lead. In addition, in the Hillyer patent the slot structure in the cavity is arranged such that insertion of the terminal causes the end of the coil lead to be drawn into the cavity.

Although the above two noted coil termination assemblies operate satisfactorily for their intended purpose, they exhibit a number of drawbacks which restrict their use. Firstly, the slots in the electrical terminal are oriented exactly at right angles to the axis of the coil lead. Thus, when the terminal is inserted into the cavity, it is possible for some of the film type insulation to remain at the conductor-terminal interface in a manner which reduces the effectiveness of the contact between the conductor and the terminal. Secondly, the relationship between the terminal and the cavity slot structure in the Hillyer patent is such that the coil lead can be completely sheared off rather than pulled into the cavity as intended.

SUMMARY OF THE INVENTION

The drawbacks of prior art coil termination assemblies are overcome by the coil termination assembly of the present invention which provides eight points of contact between the coil lead and terminal. In addition, the terminal structure of the invention provides a scraping action which causes the film type insulation to be scraped away as the terminal is inserted into the cavity so as to create a better contact between the coil lead conductor and the terminal. In addition, the present invention provides an improved mechanism for pulling the coil lead into the cavity as the terminal is inserted into the cavity which is not as prone as the structure disclosed in Hillyer to shearing off the coil lead.

The improvements of the present invention are accomplished by forming the terminal into a W shape, with a wire receiving slot being formed in each leg of the W. The wire receiving slots are parallel to, and axially aligned with one another. Each wire receiving slot begins in the bight of the leg and extends into each of the plate-like sections forming the leg. The plate-like sections are each located at an angle of other than 90° with respect to the wire axis so that as the terminal is inserted onto the wire, the desired scraping action takes place. In addition, as a result of the angular relationship between the outer plate and the coil lead axis, the end of the coil lead is pulled back into the cavity with less shearing action than prior art assemblies, thus reducing the possibility of completely shearing off the end of the coil lead.

In its broadest sense, however, the present invention comprises a terminal having one or more V-shaped portions which each make contact to the coil lead. Each V-shaped section has a slot therein extending from the bight of the V into the plate-like sections forming the V. The wire receiving slot in the plate-like section adjacent a wire guiding slot in the cavity wall acts to pull the end of the wire into the cavity when the terminal is inserted into the cavity.

BRIEF DESCRIPTION OF THE DRAWINGS

During the course of the detailed description of the invention, reference will be made to the drawings, in which:

FIG. 1 is an exploded isometric view of a housing cavity, the end of a coil lead, and the W-shaped terminal in accordance with the present invention and a second wire;

FIG. 2 is a side elevational view of the terminal of the invention, and the end of the coil lead, illustrating how the wire receiving slots and the coil lead cooperate with one another;

FIGS. 3 and 4 are side cross-sectional views of a coil termination assembly in accordance with the present invention.

FIG. 5 is an enlarged side elevational view of the W-shaped terminal of the invention and a coil lead illustrating how the film type insulation is scraped away from the conductor; and FIG. 6 is an isometric view of a coil lead to which contact has previously been made by the W-shaped terminal of the invention.

DETAILED DESCRIPTION OF THE PREFERRED EMBODIMENT OF THE INVENTION

In FIG. 1 and all the drawing Figures, only one housing cavity is depicted, it being understood that the present invention is particularly adapted for use in making electrical connections to the coil leads of electromagnetic devices in which the coils are formed from magnet wire of the film insulated type.

In accordance with the present invention, each cavity 10 is defined in a housing by a substantially planar basewall 12, and four sidewalls 14, 16, 18 and 20, respectively. The inner surface of sidewalls 14 and 18 is substantially planar, while the inner surface of sidewalls 16 and 20 include an upper planar portion **16*a* and 20*a*, respectively; and a lower tapered portion 16*b* and 20*b*, respectively which serves to narrow the cavity. The junction of the inner, upper and lower sidewall surfaces 16*a*, 16*b* and 20*a*, 20*b* is defined by small horizontal shoulders 22 and 24, respectively. Formed integrally on the basewall 12 is a tapered ridge 25 extending between sidewalls 14 and 18 and having a top planar surface which is located in the plane defined by shoulders 22 and 24. Sidewall 20 has a vertical slot 28 therein which is widened at its upper end and extends down to shoulder 24. In the same manner, sidewall 16 has a vertical slot 26 therein of the same configuration as slot 28 with the exception that slot 26 terminates just short of shoulder 22**, for reasons which will hereinafter be discussed.

A solderless terminal or connector clip 30 is adapted to be inserted into cavity 10 into which an insulated electrical conductor 32 has previously been inserted. Initially, the terminal 30 is a flat rectangular blank of suitable metal stock and it is then formed into its final W-shaped configuration shown in the drawings by conventional methods. As shown in the drawings, the W-shaped terminal has a pair of legs 34 and 36 which are each formed by two intersecting planar sections which are identified in the drawings by adding the suffix "a" or the suffix "b" to its respective leg.

In each leg of the terminal 30, an identical wire receiving slot is formed. Each of the slots are identified in the drawings as 38 and 40, respectively. Slots 38 and 40 open in the bight portion of the leg and extend upwardly into each of the plate-like sections. The wire receiving slot is identical in shape in each of the plate-like sections and is shown in more detail in FIGS. 2 and 3. Each wire receiving slot includes a widened entry portion 42 which tapers down to a narrowed contact portion 44. The transition between the widened entry portion and the narrowed contact portion 44 is marked by a shoulder 46 which serves to cut through the tough film insulation on the conductor as the slot is inserted onto the conductor. At the upper end of each slot is a pair of stop shoulders 45 which serve to limit the extent of movement of the wire into the slot and to bight into the conductor.

Each connector clip is substantially symmetrical with respect to a plane passed between legs 34 and 36 with the exception that provision is made on plate-like section **36*a* for electrically connecting a lead wire 48 and the clip 30. The preferred method for completing this electrical connection is shown in the drawings but other methods could be employed as well. Preferably, plate-like section 36*a* is extended upwardly and is situated against the inside of upper sidewall 20*a*. The end of plate-like section 36*a* is bent at a suitable angle to provide a locking tang 50 which cooperates with the middle bight 51 of the connector clip to prevent extraction of wire 48 once it is inserted into the clip. In addition, the connector clip is retained in the cavity by a plurality of pointed tabs 49** on the connector clip which bight into the plastic from which the housing is constructed.

Based on the above-noted description of the invention, the manner of using the device of the invention should be obvious to those skilled in the art. However, for sake of clarity a brief description will be given.

First, the film insulated wire 32 is placed in the cavity resting on the top of ridge 25, shoulder 24 and the end of slot 26. The end of wire 32 is then severed even with the outside of wall 16. Connector clip 30 is then inserted into the cavity. As the clip is inserted, the housing will support wire 32 and the wire will be forced deeper and deeper into the slots in the legs of the W-shaped clip. In addition, as the W-shaped clip is inserted onto the wire, the V-shaped structure of each leg will essentially create an insulation stripping motion having horizontal and vertical components. The horizontal component causes the insulation to be stripped axially on the wire while the vertical component allows the slots to make contact to the conductor as depicted in FIG. 5. Eventually the clip will reach the position shown in FIG. 4 where shoulder 45 will actually pull downwardly on the wire 32 to cause its end to be pulled into the cavity. At this point, pointed tabs 49 will retain the clip in the cavity. Subsequently, the lead wire 48 from which insulation has been stripped is inserted between tang 50 and upper bight 51.

The termination assembly of the invention represent a definite improvement over the prior art by providing eight points of contact with the wire rather than four. Further, the V-shaped structure of the legs causes the stripping action which means that each contact to the film insulated wire is not degraded by insulation between the terminal and conductor.

Obvious variations of the above-described termination assembly will occur to those skilled in the art. Accordingly, it is intended that the above-noted description be made for exemplary purposes only and that the scope of the invention be defined in the claims.

We claim:

1. An electrical connection of a magnet wire having a film type insulation coating thereon to a lead wire conductor comprising:

an insulative housing having at least one connector clip receiving cavity therein; each said cavity being defined by a basewall and four upstanding sidewalls and being open at the end opposite said basewall; said basewall having an upstanding support platform extending toward the open end of said cavity and located between a first pair of opposing sidewalls to define first and second valleys in said cavity; said platform having a top surface spaced from the open end of said cavity; a magnet wire receiving guide slot having an open end and a closed end and being formed in each of said opposing sidewalls; said guide slots extending in said first opposing sidewalls from the open end of said cavity along axes generally parallel to each other and terminating at their closed ends at substantially the same level as the top surface of said platform;

said magnet wire being positioned in said guide slots and extending longitudinally through said cavity across the top surface of said support platform;

a connector clip of a generally W-shaped configuration comprising a single strip of metal stock having an intermediate bight portion, diverging first and second leg sections extending downwardly from opposite ends of the intermediate bight portion, and diverging third and fourth leg sections extending upwardly and connected, respectively, at their lower ends by first and second reverse bends with the lower ends of said first and second downwardly extending leg sections; said first and third leg sections defining a first V-shaped leg structure, and said second and fourth leg sections defining a second V-shaped structure; first and second wire-receiving slot openings formed in said connector clip; said first slot opening bisecting said first reverse bend and extending upwardly in both of said first and third leg sections; said second slot opening bisecting said second reverse bend and extending upwardly in both of said second and fourth leg sections; a wire entry portion of a slot opening extending through each of said return bends having a width which is greater than the diameter of said magnet wire; a respective contact portion of said slot openings in each of said leg sections having a reduced width which is slightly less than the diameter of said magnet wire; said connector clip including contact means for forming an electrical connection with said lead wire conductor; said connector clip including locking means engagable with at least one of said sidewalls for retaining said connector clip in said cavity;

said connector clip being inserted into said cavity with said return bends received in respective valleys of said cavity and with said slot openings in alignment with said guide slots in said opposing walls; said magnet wire extending through said slot opening in each of said leg sections and being wedged between the opposing edges of the reduced width contact portion of each said slot opening to provide eight zones of electrical and mechanical connection between said magnet wire and said connector clip; said leg sections each being inclined relative to the longitudinal axis of said magnet wire; each of said V-shaped leg structures being movable over said magnet wire as said connector clip is inserted into said cavity to provide an insulation coating stripping motion by the opposing edges of each said slot opening which forms said zones of electrical and mechanical connection; said stripping motion having a first component which causes penetration of said insulation coating laterally of the axis of said magnet wire and a second component which causes the insulation coating to be stripped axially on said magnet wire.

2. The electrical connection of claim 1 wherein:

each contact portion of said slot openings in said leg sections includes a pair of stop shoulders to limit the extent of movement of said magnet wire into said slot openings and to bight into said magnet wire.

3. The electrical connection of claim 2 wherein:

the closed end of one of said guide slots is located slightly nearer the open end of said cavity than said top surface of said platform whereby said pair of stop shoulders on the leg section adjoining said one guide slot is effective to pull within said cavity the end of said magnet wire positioned in said one guide slot as said connector clip is fully inserted into said cavity.

* * * * *